United States Patent [19]

Fagan

[11] 4,229,877

[45] Oct. 28, 1980

[54] FLORA ATTACHING DEVICE

[76] Inventor: James D. Fagan, 631 Deerwood Dr., Columbia, S.C. 29205

[21] Appl. No.: 16,846

[22] Filed: Mar. 2, 1979

[51] Int. Cl.[3] ..... B21D 39/00; B23P 11/00; A45F 5/08

[52] U.S. Cl. ..... 29/509; 29/526 R; 24/6; 24/150 R

[58] Field of Search ..... 24/6, 3 M, 150 R, 162, 24/3 H; 29/509, 526 R, 526 A

[56] References Cited

U.S. PATENT DOCUMENTS

| | | | |
|---|---|---|---|
| 174,364 | 3/1876 | Hurdle | 24/6 |
| 303,652 | 8/1884 | Marston | 24/6 |
| 420,953 | 2/1890 | Nelson | 24/6 |
| 471,181 | 3/1892 | Laun | 24/6 |
| 508,149 | 11/1893 | Schumm | 24/6 |
| 598,780 | 2/1898 | Harris | 24/6 |
| 693,150 | 2/1902 | Potter | 24/6 |
| 886,215 | 4/1908 | Hudson | 29/509 |
| 1,123,352 | 1/1915 | Neiman | 24/6 |
| 1,406,683 | 2/1922 | Regan | 29/509 |
| 1,987,127 | 1/1935 | Rice | 29/526 |
| 2,206,933 | 7/1940 | Anglim | 24/6 |
| 2,495,012 | 1/1950 | Kugler | 24/3 H |
| 2,575,213 | 11/1951 | Fruth | 29/526 |
| 3,336,638 | 8/1967 | Peters et al. | 24/6 |

FOREIGN PATENT DOCUMENTS

| | | | |
|---|---|---|---|
| 63459 | 6/1913 | Austria | 24/6 |
| 402990 | 10/1909 | France | 24/150 R |

*Primary Examiner*—Victor N. Sakran

*Attorney, Agent, or Firm*—Pollock, Vande Sande & Priddy

[57] ABSTRACT

The invention includes a U-shaped pin with a base for passing around and engaging the shank of a flora arrangement and parallel prongs projecting outward from the base. The prongs have sharp points for piercing through clothing material from front to rear and engage a backing board on the rear side of the material, the backing board having two sets of apertures one for receiving each prong as it exits from the rear face of the clothing material. After passing through the appropriately spaced apertures, the prongs are bent so as to be retained therein with the sharp points against the rear surface of the board. A facing board with apertures for passing the prongs of the pin may also be employed on the front side of the clothing material. The method of using the apparatus for attaching a flora arrangement to clothing is also described.

12 Claims, 9 Drawing Figures

FIG.1
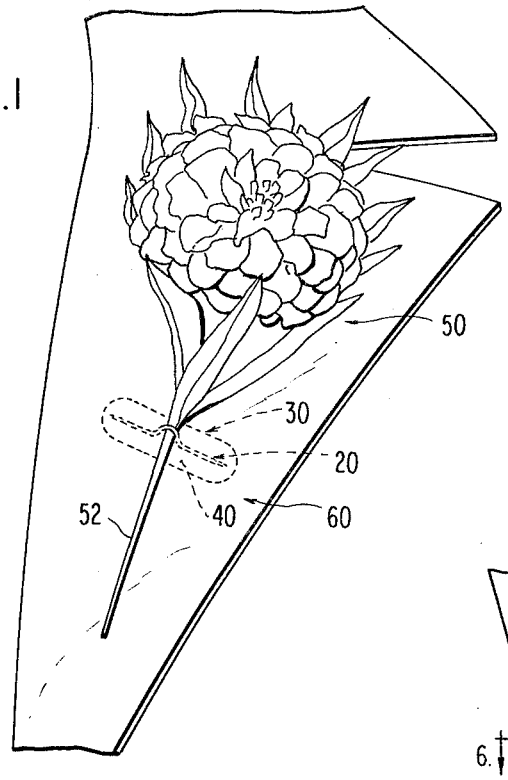
FIG.2
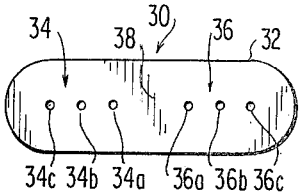
FIG.3
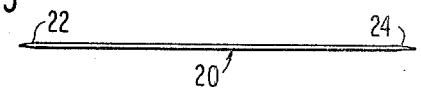
FIG.4
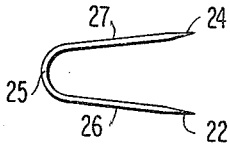
FIG.5
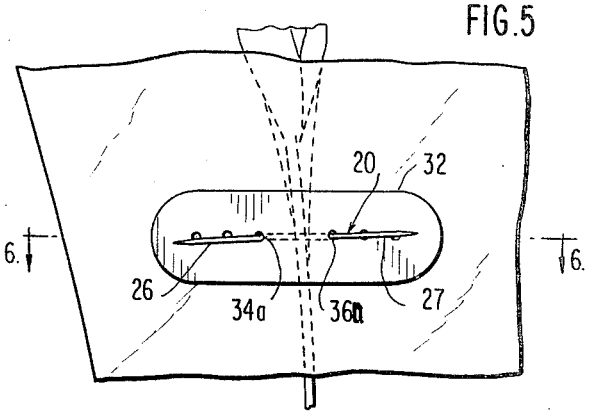
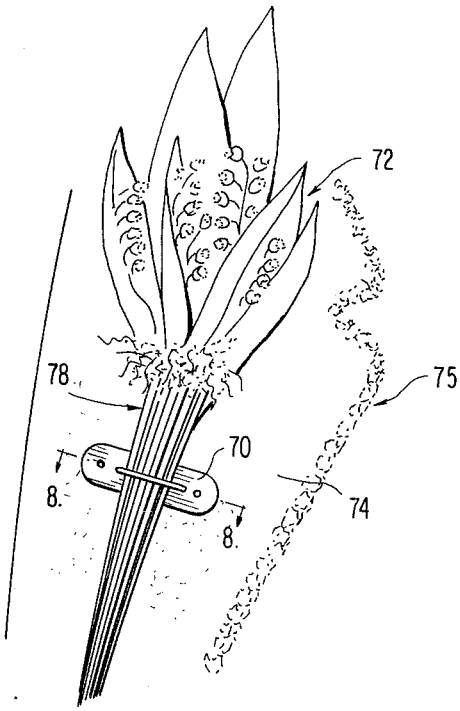
FIG.7
FIG.6
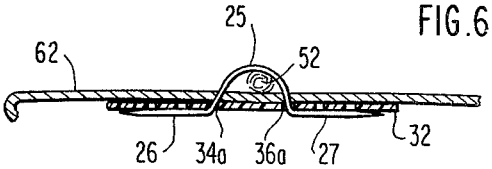
FIG.8
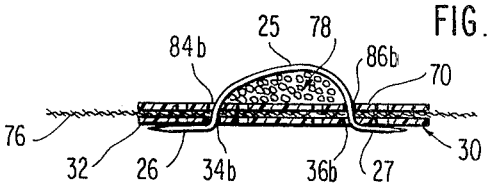
FIG.9
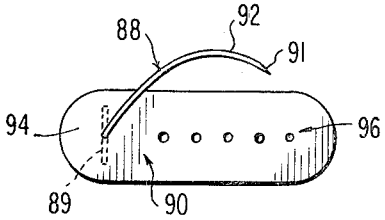

FLORA ATTACHING DEVICE

BACKGROUND OF THE INVENTION

This invention relates to apparatus for attaching flora arrangements to clothing, and more particularly to a device for securing the stems of flowers and other flora to the material of a garment in the form of a bouquet. The device can be used for attaching either a single flower or a multiple stem bouquet of two or more flowers or other flora. The invention also relates to a method for attaching flora of different sizes to clothing.

In the past, corsages and bouquets of various types of flora have been attached to garments by inserting a straight pin through the garment, over the stems of the flora, and back into the garment on the other side of the stems. This method of attachment usually leaves the sharp end of the pin exposed on either the front or the rear side of the material where it can catch on other objects and cause injury to the wearer or other persons or damage to clothing. Straight pins also can easily work their way out of a secure position such that the flora arrangement becomes detached from the clothing and lost or damaged.

It is also well known to clamp or insert the stems of flora into an externally mounted structure having prongs which first pierce the clothing material and are then bent back against the underside or rear surface thereof. In such devices and in the conventional pinning method previously described, the clothing material, usually cloth, is backed only by the pin or prongs which pass through the material and across its rear surface. Another disadvantage of the double pronged devices found in the prior art is their inability to readily accommodate a wide variety of different stem sizes and numbers. Previously known devices are usually preshaped for a specific size of flora arrangement and cannot readily accommodate larger or smaller size arrangements.

Prior art pinning devices of the foregoing types are loosely suspended and are relatively free to shift out of position so as to give an unsightly appearance. The thin shaft of a bare pin or prong can also cause the material to pucker and hang in an unsightly manner, and when the device is removed, unsightly folds or wrinkles are left in the cloth or other clothing material. Furthermore, localized stresses present where a thin shaft pierces unsupported material can result in easily tearing or ripping the garment, especially where efforts to attach or remove such devices are made in a hurried manner. Another problem with such prior art devices is their inability to shield the sharply pointed end or ends of the pins or prongs so that they do not hook other parts of the clothing, prick the wearer, or otherwise cause a safety hazard.

SUMMARY OF THE INVENTION

Such problems, disadvantages and limitations encountered with prior art devices are overcome by the novel structure of the present invention which is adjustable to accommodate flora arrangements with shanks of widely varying sizes and shapes. The shank of a flora arrangement may be comprised of a single stem or a composite of multiple stems or other base structure of the particular flora making up the arrangement. The size of the shank is determined by the number and size of individual stems supporting the upper blossom or foliage portion. The invention provides a relatively rigid backing to firmly support the rear side of the clothing material and distribute the weight of the flora arrangement over a relatively large area of clothing and underlying supporting surfaces. Another object of the invention is to provide a shield to cover and protect the material piercing portion of the device so as to avoid the hazard of sharp projecting pin-like ends. The structure also firmly engages the clothing material to which it is secured so as to prevent accidental displacement or dislodgment of the flora arrangement. These and other objects and advantages will be apparent to those persons skilled in the art from the attached drawing, the detailed description of the preferred embodiment set out below, and this specification as a whole.

The foregoing objects are accomplished by the novel structure of the invention which includes as a kit an elongated backing board of relatively rigid but resiliently flexible material and a deformable pin with a sharp point at least at one end. The board has at least one set of adjustment apertures along its length in the longitudinal direction. The pin is deformable into a U-shape with a variable size base for passing around flora stems of various sizes and numbers and a free prong adjacent to the sharp end for passing through any of the adjustment apertures in the backing board. The base of the pin passes around the flora stems and the free prong pierces the clothing material and then passes through the appropriate aperture in the backing board, depending upon the size of the composite stem shank. Thereupon, the free projecting end of the pin is bent outwardly toward one of the respective ends and against the rear surface of the backing board. The other end of the pin may be either embedded in the backing board or a sharp free end. In the latter case, which is preferred, the backing board has a second set of adjustment apertures and the other end of the pin forms a second prong for cooperating with those apertures in the same manner that the first prong cooperates with the first set of apertures.

The length of the pin relative to the length of the backing board is such that the ends of the pin do not extend beyond the ends of the backing board body but are protected thereby. The front side of the backing board is substantially planar so as to provide a flat backing surface for pressing against and supporting the rear side of the clothing material adjacent to where the material is penetrated by the prongs of the pin.

BRIEF DESCRIPTION OF THE DRAWINGS

The invention, both as to its structure and method of manufacture and use, may be further understood by reference to the detailed description below taken in conjunction with the accompanying drawing in which:

FIG. 1 is a front elevational view of the invention illustrating attachment of a single stem bouquet to the lapel of a blouse or coat.

FIG. 2 is an elevational view of the backing board component.

FIG. 3 is a plan view of the undeformed pin component.

FIG. 4 is a side view of the pin component after initial deformation but before attachment.

FIG. 5 is a rear elevational view of the invention as used in FIG. 1.

FIG. 6 is a sectional view of the invention taken along line 6—6 of FIG. 5.

FIG. 7 is a front elevational view of the invention illustrating attachment of a multiple stem bouquet to the lapel of a blouse or coat and also showing the optional use of a facing board component.

FIG. 8 is a sectional view of the invention taken along line 8—8 of FIG. 7.

FIG. 9 is a perspective view of a modification of the invention.

DETAILED DESCRIPTION OF THE INVENTION

One embodiment of the flora attaching device of the present invention is shown in FIGS. 1 through 6 of the drawing and comprises a pin component, generally designated 20, and a backing board component, generally designated 30. The respective ends 22 and 24 of the pin 20 have sharp points for piercing clothing material such as cloth, or any of the more modernistic materials, such as paper or plastic. When pin 20 is bent into a U-shape as shown in FIG. 4, it has a base 25 and two prongs 26 and 27 extending outward from the base in a substantially parallel, spaced-apart relationship.

The backing board 30 is comprised of an elongated body 32 having two sets of holes or apertures, generally designated 34 and 36, on either side of a central transverse portion 38. In the embodiment shown, each of the sets 34 and 36 are preferably comprised of an equal number of apertures, three being shown. The apertures of set 34 are designated 34*a*, 34*b* and 34*c*, respectively, and the apertures of set 36 are designated 36*a*, 36*b* and 36*c*, respectively. However, it is to be understood that either set may contain only one or any other number of apertures as desired.

When the pin of FIG. 3 is used, it is bent around a flora arrangement into a U-shape resembling FIG. 4. In this configuration, the sharp ends 22 and 24 project in the same direction and the prongs 26 and 27 are substantially parallel. The adjustment apertures in the backing board 30 are each sized to receive the prongs of the pin. The pin is preferably made of a readily deformable material such as a pliable steel composition or similar alloy. One important feature of the invention is that the portion of the pin forming the base of the U-shape is readily deformable so as to bend around bouquets or other flora arrangements with shanks of varying shapes and diameters. The diameter of the shank establishes the lateral spacing between the prongs 26 and 27 which should be substantially parallel to each other for insertion through the clothing material. This lateral spacing in turn establishes which aperture of each set of apertures is to receive a prong of the pin, opposing apertures 34*a* and 36*a* being used for the smallest shank size and opposing apertures 34*c* and 36*c* being used for the largest shank size. It is to be understood that where the components 20 and 30 are sold or supplied as a kit, the pin may be preformed in the U-shape of FIG. 4. However, where furnished separately, it is best to leave the pin straight for bulk packaging.

The method of using the present invention will now be described with reference to FIGS. 1 and 6. The mid portion of the pin 20 is first bent around the shank 52 of a flora arrangement 50 to produce the base 25 and the prongs 26 and 27. The projecting prongs of the pin are then placed normal to the front of the lapel 60, or other area of clothing material to which the arrangement is to be attached, and forced through the lapel material 62 by pressing on the base with the thumb of one hand while the pin is held in position on the flora shank with the remaining fingers of the same hand. After the prongs have pierced the material, they are passed through the opposing apertures with a spacing most nearly conforming to the lateral spacing between the prongs. FIG. 6 illustrates the use of apertures 34*a* and 36*a* and FIG. 8 the use of apertures 34*b* and 36*b*. Should the ends of the prongs fall intermediate to the spacing of any given pair of opposing apertures and the next more widely spaced pair, it is preferable to bend the prongs so as to pass through the more closely spaced pair as this will provide the tighter engagement between the base of the pin and the shank of the flora around which it passes. After the prongs of the pin pass through the appropriate pair of apertures, the clothing material is pressed firmly between the flat backing surface 40 on the front side of the backing board body 32 and the floral arrangement by pressing a thumb down on the pin base 25 while opposing pressure is applied behind the respective end portions of the backing board by the index finger and middle finger of the same hand. While the flora arrangement is thus held snug against the garment, the rearwardly projecting pin prongs are bent outwardly and down against the respective end portions of the backing board.

The body 32 of the backing board is preferably of a flexible resilient material such that the opposing outer portions of both the body and the prongs can be pressed forwardly beyond their ultimate attached position. The sharp ends of the prongs will thereby be pressed snugly against the rear surface of the backing board by the resilence of the body 32 when the backing board is released and returns to its planar shape after final deformation of the prongs. The length of pin 20 is preferably selected so that its sharp ends will not project beyond the end portions of the backing board body. The backing board thus provides an overlying protective cover for the sharp ends of the prongs when those prongs are pressed against the rear side of the backing board as previously described. To insure that the sharp ends of the prongs will not project beyond the body 32 even when small flora arrangements dictate the use of the centermost apertures of each aperture set, the length of pin 20 should not exceed the length of backing board 30.

To remove the flora arrangement from the garment, the outwardly bent portions of the prongs 26 and 27 are straightened out so that the pin can be withdrawn from the backing board and the overlying garment material. The pin, together with the arrangement, is then pulled free of the backing board and the garment material. If an existing bouquet is to be replaced by a new bouquet or other flora arrangement, the prongs need not be fully straightened but instead bent sufficiently toward each other to loosen the base 25 from engagement with the flora shank. This will permit removal of the old bouquet and the shank of the new bouquet may then be inserted in the space between the base of the pin and the adjacent garment material. When storing the device after initial use, the pin is preferably inserted back through the centermost apertures and the ends bent back to secure the pin to the backing board and thereby prevent it from becoming separated and misplaced. Even with the pin fully inserted through the central apertures for storage, the sharp ends of the pin will not project beyond the respective ends of the backing board where the length of the pin is approximately equal to or less than the longitudinal length of the body 32.

A modification of the device particularly useful for clothing material that is relatively thin is shown in FIGS. 7 and 8. In this embodiment, a second board component, designated as facing board 70, is utilized between a multiple stem bouquet 72 and the front surface 74 of a lapel 75 made of cloth 76. The facing board preferably is identical in all respects to the backing board so that it need not be described in further detail. However, it is to be understood that the boards 30 and 70 may be of different sizes. For example, the shape and size of the facing board may be selected for its aesthetic appearance while the features of the backing board are based on providing sufficient backing surface to allow a thin garment material to adequately support the flora arrangement to be attached by the invention.

In assembling this modified embodiment, the base 25 of pin 20 is bent around the composite shank 78 of multiple stems and the projecting prongs 26 and 27 of the pin are passed through the appropriately spaced apertures 84*b* and 86*b* in the facing board 70. The rearwardly positioned prongs are then pushed through the garment material 76, inserted through the appropriate apertures 34*b* and 36*b* of the backing board 30, and then bent back against the rear side of the backing board to tightly secure the resulting sandwich structure together as shown in FIG. 8. The thin garment material 76 is thereby tightly wedged or sandwiched between two supporting surfaces, namely, the planar rear surface of the facing board 70 and the planar front surface of the backing board 30. The thin material of the garment is thereby firmly supported in the area surrounding the points of prong penetration. This gives the lapel, bodice or other portion of the garment to which the invention is attached the added strength necessary for carrying the weight of the flora arrangement without unsightly distortion of the garment material.

Yet another embodiment of the invention is shown in FIG. 9. Here, one end of the pin 88 has a crossbar 89 which is embedded in the body of a backing board 90 which is preferably made of a moldable plastic. The other end of the pin is sharpened at 91 and forms a freely projecting prong 92. The embedded end of the pin is preferably located near one end 94 of the board 90 and a single set of apertures 96 are utilized to permit adjustment for stem shanks of different sizes. In this embodiment, there is no need for a central body similar to portion 38 of board 30, but instead the single set of apertures 96 are evenly spaced along the body of the board 90 from the embedded end of the pin to the opposite end of the board. In using this modification, the backing board is first placed behind the garment material with the free prong 92 of the pin piercing through that material and extending forwardly from the front face thereof. The free prong is then bent around the shank of a bouquet and directed back through the material so as to also pass through one of the apertures of the aperture set 96. The rearwardly projecting portion of the prong is then bent outwardly and forward while the resulting sandwich-like structure is pressed firmly together in a manner similar to that previously described.

In the preferred embodiments, the pin is made preferably from a wire rod of about 12 to 16 gauge cut into lengths of about two inches. The body of the backing and facing boards is approximately the same length, namely, about two inches, and has a width of approximately three-quarters of an inch.

The foregoing specific embodiments are merely exemplary of the various embodiments possible and the true scope of the invention is not to be limited to those embodiments but is defined by the claims at the end of this specification. Other embodiments and modifications of the flora attaching apparatus and method of the invention will be apparent to those skilled in the art from consideration of this disclosure as a whole. Thus, various changes can be made in the thickness and other dimensions of the backing and facing boards and in the length and cross-sectional shape of the pin cooperating therewith. As previously indicated, both the pin and the boards may be made from various materials having the preferred characteristics described. These and other modifications that may occur to those skilled in the art are within the contemplation of this invention.

What is claimed is:

1. A method of attaching the shank of a flora arrangement to the front side of clothing material comprising:

passing an elongated pin around the shank of said flora arrangement, said pin being of a deformable material and comprising a base and a pair of prongs extending away from said base;

deforming said pin to conform said base to at least a portion of the cross-sectional shape of said flora shank and said prongs to a substantially parallel spaced-apart relation;

passing at least a portion of each of said prongs through said clothing material so as to hold said flora shank between said base and the front face of said clothing material;

placing an elongated body against the rear face of said material, said elongated body having a substantially planar backing surface for abutting the rear face of said material over a relatively large area around the points where said prongs pass through said material; and, securing said prongs to said elongated body so as to press the base of said pin against said flora shank, said flora shank against the front face of said material and the backing surface of said elongated body against the rear face of said material, said elongated body further including retaining means for securing each of said prongs.

2. The method of claim 1 in which said prongs are inserted through spaced-apart apertures in a second elongated body before both of said prongs have been passed through said clothing material, said second elongated body having a substantially planar surface for abutting the front face of said material when said prongs are secured to said first elongated body.

3. The method of claim 1 in which said retaining means inlcudes at least one aperture for receiving a free end of one of said prongs, and in which said securing step includes passing said free end through said aperture and deforming said one prong relative to the other side of said elongated body.

4. The method of claim 3 in which the base of said pin is conformable to flora shanks of different sizes for variable spacing between said substantially parallel prongs and said elongated body includes a set of apertures having two or more apertures for receiving said free prong end, one aperture of said set being positioned to receive said free prong end when said base is conformed to a first flora shank and the other apertures of said set being positioned to receive said free prong end when said base is conformed to a flora shank larger in transverse size than said first flora shank.

5. The method of claim 4 in which said elongated body further includes a second set of apertures for receiving a free end of the other of said prongs, a respective aperture of said first set being spaced longitudinally apart from a respective aperture of said second set by a distance approximately equal to the lateral spacing between said substantially parallel prongs, and in which said securing step includes passing the free ends of said spaced-apart prongs through the respective apertures of said first and second sets and bending the portions of said prongs passing through said respective apertures against the respective ends of said elongated body so that the prongs of said pin are lodged within said apertures with their free ends adjacent to the rear surface of said elongated body.

6. The method of claim 5 in which each of said sets includes at least two apertures.

7. The method of claim 6 in which said prongs are passed through respective spaced-apart apertures in a second elongated body before both of said prongs have been passed through said clothing material, said second elongated body including two sets of apertures and each of said sets including at least two apertures, the spacing between the respective apertures of said second elongated body being approximately equal to the spacing between the respective apertures of said first elongated body.

8. The method of claim 3 in which said elongated body is comprised of a flexible, resilient material capable of returning said backing surface to its original configuration after said body and the end of the prong passing through said aperture have been deformed through the plane of said backing surface and then released from said deformation.

9. The method of claim 8 in which said material is plastic.

10. The method of claim 3 in which the end of said other prong is embedded in said elongated body, and in which said elongated pin is first passed through said clothing material from its rear face, then passed around said flora shank, and then passed back through said material from its front face.

11. A kit for performing the method of claim 1, claim 3, claim 4, claim 5, claim 6, claim 8, claim 9 or claim 10 in which said kit comprises said elongated pin and said elongated body.

12. A kit for performing the method of claim 2 or claim 7 in which said kit comprises said elongated pin and said first and second elongated bodies.

* * * * *